US008172369B2

(12) United States Patent
Bergstedt et al.

(10) Patent No.: US 8,172,369 B2
(45) Date of Patent: May 8, 2012

(54) INKJET PRINTHEAD SUBSTRATE WITH DISTRIBUTED HEATER ELEMENTS

(75) Inventors: Steven Wayne Bergstedt, Winchester, KY (US); Prabuddha Jyotindra Mehta, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 727 days.

(21) Appl. No.: 12/346,189

(22) Filed: Dec. 30, 2008

(65) Prior Publication Data

US 2010/0165053 A1 Jul. 1, 2010

(51) Int. Cl.
*B41J 2/05* (2006.01)

(52) U.S. Cl. ..... 347/62; 347/60

(58) Field of Classification Search ..... 347/19, 347/60, 62

See application file for complete search history.

(56) References Cited

U.S. PATENT DOCUMENTS

| | | | | |
|---|---|---|---|---|
| 5,815,180 | A * | 9/1998 | Barbour et al. | 347/59 |
| 6,102,515 | A | 8/2000 | Edwards et al. | |
| 6,170,936 | B1 * | 1/2001 | Ahne et al. | 347/57 |
| 6,357,863 | B1 | 3/2002 | Anderson et al. | |
| 6,789,871 | B2 | 9/2004 | Edelen et al. | |
| 7,163,272 | B2 | 1/2007 | Parish et al. | |
| 7,384,115 | B2 | 6/2008 | Barkley | |
| 2002/0149649 | A1 * | 10/2002 | Moon et al. | 347/62 |

* cited by examiner

*Primary Examiner* — Geoffrey Mruk

(57) ABSTRACT

A substrate heating system for an inkjet printhead. The substrate heating system includes heating resistors distributed in association with the ink jet nozzle structures, and located thermally adjacent thereto. The plural switching transistors that control the current through the substrate heating resistors are also distributed with the ink jetting nozzle structures, together with the substrate heating resistors. Polysilicon is used in constructing the substrate heating resistors. Cells of the substrate heaters can be arranged physically in a linear manner, along the nozzle structures. The substrate heater cells can be controlled so that the temperature of various zones of nozzle structures can be controlled.

17 Claims, 3 Drawing Sheets

INKJET PRINTHEAD SUBSTRATE WITH DISTRIBUTED HEATER ELEMENTS

BACKGROUND

1. Field of the Invention

The present invention relates in general to inkjet printheads, and more particularly to substrate heaters for heating the ink in the printheads of inkjet printers.

2. Description of the Related Art

The process of printing employing inkjet techniques requires a thermally controlled environment to maintain a desired print quality and color consistency. The thermal energy generated within the integrated circuit of a printhead heats the ink held therein. Ideally, the temperature of the ink should remain constant at a desired temperature. A change in the temperature of the ink results in the change in the properties of the ink, including the viscosity, surface tension, droplet size, etc. The print quality changes as these ink parameters change. Over very short periods of time, the ink is jetted from numerous nozzles many times. In order to cause jetting of ink from a printhead, the ink drops are ejected by a process of nucleating a single bubble at an intense heat for a very short duration. This process is repeated thousands of times per second for each nozzle. This results is an accumulation of heat that raises the temperature of the ink, which is undesirable. On the other hand, when the printer is idle for some period of time, the ink tends to cool without the use of some type of heater. In addition to the foregoing, all portions of the printhead are generally not at the same temperature. Rather, some areas of the printhead can be warmer or cooler than other areas of the printhead. These gradients in the printhead temperature can be dynamic, meaning that they change over time as a function of various reasons, including the pattern of nozzle use, ventilation, ambient temperature, etc. These variations in the temperature of the ink can lead to poor print quality that is visible. Thus, the management of the printhead temperature is not an easy task. Thermal control systems have been incorporated on inkjet printhead integrated circuits to sense temperature and apply heat as needed to maintain the ink at a constant temperature independent of print pattern density. The heating systems require transistor switching devices to turn on and off the heating elements. The switching devices and heating elements require some physical area in the printhead integrated circuit and contribute to the die size and ultimately to the printhead die cost.

Some integrated circuit heating systems, for example, the Non-Nucleating Heating (NNH) system and the printhead integrated circuit heating system disclosed in U.S. Pat. No. 7,384,115 by Barkley, use the same heater and switch device used by the nozzle jetting system. In this heating system, the nozzle heaters are addressed with a pulse energy that is sufficient to generate substrate heat, but insufficient to nucleate the ink and jet a droplet from the nozzle. The disadvantage of this technique is that it can only be used to generate substrate heat when the particular nozzle heater is not jetting. While these systems are attractive because they minimize silicon area, they require an additional pin to implement the short duration pulses required to prevent jetting during heating. The additional pin adds to die width and increases the cost of the printhead. In addition, using the same transistor switching device (power FET) that is used in the jetting system ages the switch and causes an unnecessary shift in key parameters over the life of the printhead.

Furthermore, these NNH systems require either switch matrices or multiplexers to control whether the heater is using the inkjet fire signal or the substrate heating signal. These multiplexers also require additional silicon area on the semiconductor substrate. Some inkjet printhead systems use heating elements around the periphery of the printhead integrated circuit and thus do not add to the die width because the heating elements are located in vacant spaces along the edges of the semiconductor die. These heating systems apply heat away from the nozzle jetting heaters and are not as effective because they are not located near the inkjet nozzles.

As noted above, when utilizing a temperature control system in an inkjet printhead, there must also be provisions for sensing the temperature, and through a feedback loop, controlling the temperature of the semiconductor substrate. Attempts have been made to place temperature sensors at various locations in the substrate, it being understood that the outer edges of the semiconductor substrate tend to be cooler as the thermal energy can be more easily dissipated to the air or to the structure to which the substrate is mounted. The temperature control of the substrate is efficient, but often the temperature sensors only sense the temperature at a particular location and serve to control the temperature as such location, while the nozzle structure locations still experience temperature gradients, albeit at a smaller degree. Some substrate heater designs tend to locate the heater systems at efficient peripheral locations on the substrate, while neglecting to consider that it is the nozzle locations that require precise temperature control.

U.S. Pat. No. 6,357,863 by Anderson et al., discloses a linear substrate heater for an ink jet printhead. Here, incorporated into the integrated circuit are resistive nozzle jetting heaters and substrate heating resistors. The substrate heating resistors are located closer to the edge of the silicon chip than to the ink reservoir. The substrate heating resistors are selected with different resistance values to accommodate the different amounts of heat generated at different areas of the semiconductor chip.

U.S. Pat. No. 6,102,515 by Edwards et al., discloses a printhead driver employing both nozzle jetting heaters and a substrate heater. The two substrate heaters are located at opposite ends of the semiconductor chip, outside the area where the jetting heaters are located. The jetting heaters and the substrate heater can be activated separately or together using enable signals and corresponding enabling circuitry, without the use of a separate driver for the substrate heater. U.S. Pat. No. 7,163,272 by Parish et al., discloses the use of additional nozzle jetting heaters for the purpose of heating the substrate, as opposed to the use of other nozzle jetting heaters for heating the ink to nucleate the same into a bubble.

It can be seen from the foregoing that various attempts have been made to incorporate heaters into the integrated circuit of a printhead. While exotic and complicated heating systems are an option to carefully control the substrate heat, and thus the temperature of the ink, such heating systems generally function well at the expense of using much more silicon area, which increases the cost of the printhead, and makes the printhead more prone to failure because of the complexity thereof.

From the foregoing, it can be seen that a need exists for a temperature control for an inkjet printhead that maintains the substrate areas adjacent the nozzle structures at a constant temperature, where temperature control is necessary. A need exists for distributing the substrate heating elements adjacent the nozzle structures to concentrate the thermal energy where it is necessary. Another need exists for a substrate heating system where both the heating elements and the switching transistors, which switch the heating element on and off, are co-located next to the corresponding nozzle structures. A further need exists for a substrate heating system that includes series-connected heating resistors distributed with the nozzle structures, and parallel-connected switching transistors, also distributed and located next to the nozzle structures with a heating resistor. Another need exists for a printhead that incorporates a substrate heater system therein while yet minimizing semiconductor area and requiring no additional pins or terminals.

SUMMARY OF THE INVENTION

In accordance with the invention, disclosed is a printhead substrate heater with resistive heating elements and transistor switches for switching current through the heater resistors. According to a feature of the invention, the heating resistors and the switching transistors are distributed over the substrate area. A nozzle is located thermally adjacent a substrate heating resistor and a transistor switch to maintain the ink temperature uniform around the nozzle structure.

The substrate heating system according to a feature of the invention includes a number of heater cells, each constructed with plural distributed heating resistors and plural switching transistors. Each substrate heating cell includes a heater resistor string, where such heater string is switched on or off using plural parallel-connected FET switching transistors. According to an embodiment, a nozzle is located thermally adjacent a pair of FET switching transistors and a substrate heating resistor. A number of substrate heater cells can be arranged to accommodate a longer ink via, or additional ink vias. The heater cells can be driven together by a common drive signal, or driven separately.

In embodiments of the invention, in the design of a substrate heater, one or more of the nozzle jetting transistors of a group can be used for the substrate heating transistors. The nozzle heater resistance can be increased to accommodate the fewer number of nozzle jetting transistors so that the thermal energy generated remains the same. In other words, since the nozzle drive transistors and the substrate heater switching transistors are co-located adjacent one or more nozzle structures, both types of transistors can share the same design and even some of the same connections and conductors.

In embodiments of the invention, the substrate heating resistors are fabricated during the semiconductor process using polysilicon. The polysilicon resistors of a heater string are connected with metal interconnections. The polysilicon resistor allows other conductors to be routed thereover, thus making efficient use of the semiconductor area, and thus minimizing the cost of the printhead substrate. Moreover, by locating the polysilicon resistor element thermally adjacent a nozzle structure, less thermal energy is required to maintain the ink at a desired temperature. In addition, with a switching transistor located adjacent the nozzle structure together with the polysilicon resistor, any heat generated by the switching transistor contributes to the heating of the ink and is not lost in heating other areas of the printhead substrate.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 2A:
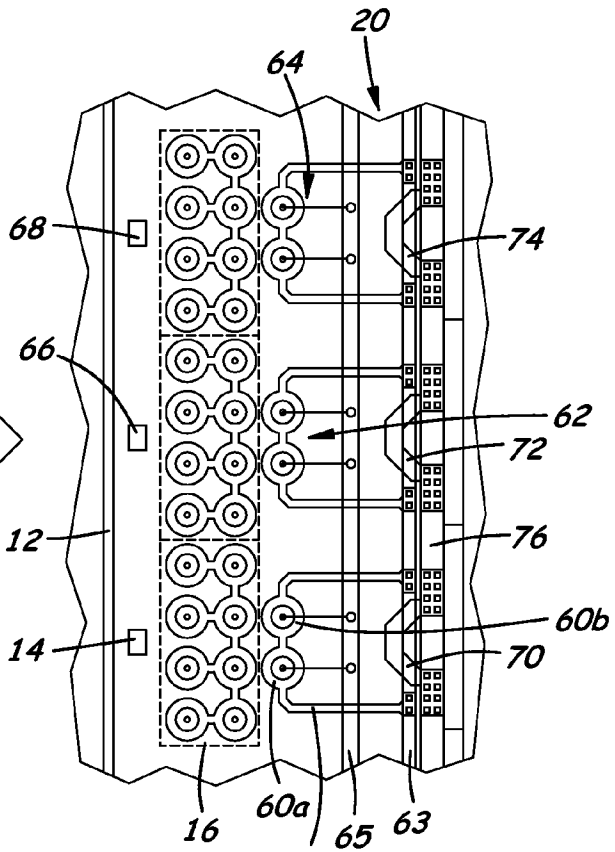
FIG. 2*a* is a much enlarged drawing of the components forming a portion of the substrate heater according to an embodiment of the invention.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware.

However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

The present invention provides a system and method for controlling the temperature of the substrate of an inkjet printhead. The term image as used herein encompasses any printed or digital form of text, graphic, or combination thereof. The term output as used herein encompasses output from any printing device such as color and black-and-white copiers, color and black-and-white printers, and so-called "all-in-one devices" that incorporate multiple functions such as scanning, copying, and printing capabilities in one device. Such printing devices may utilize ink jet, dot matrix, dye sublimation, laser, and any other suitable print formats.

Figure 1:
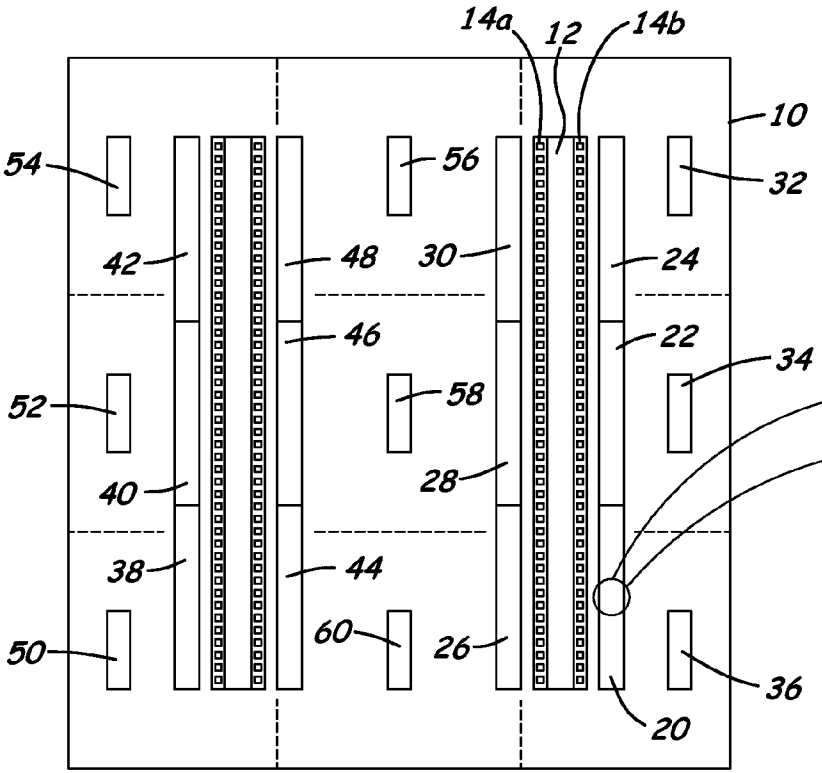
FIG. 1 is a block diagram of an inkjet printhead showing the various heating zones for heating the printhead substrate, and the location of the substrate heaters adjacent the nozzle structures.

FIG. 1 illustrates in block diagram form an embodiment of an inkjet printhead 10 adapted for jetting droplets of ink therefrom onto a print medium. The drawings are not to scale, but are drawn to depict various features of the invention. The printhead 10 can be connected to an ink cartridge (not shown) that supplies liquid ink to the printhead 10. The cartridge would be mounted underneath the printhead, as shown in the drawing, and a nozzle plate (not shown) would be mounted on top of the printhead 10. The ink is drawn by capillary action from the cartridge, or ink tank, into elongate reservoirs or vias, one shown as numeral 12. There are two ink vias in the printhead 10 illustrated, although other numbers of ink vias can be employed as a function of the number of jetting nozzles utilized, as well as other things. A row of nozzles 14*a* and 14*b* is located immediately adjacent the ink via 12, on at least one side thereof, in the illustration the nozzles are on both sides of the via. The nozzles 14*a* and 14*b* are of a conventional type in which a droplet of ink is jetted therefrom in response to the concentrated heating of a very small volume of ink to form a bubble which bursts and jets as a drop from the nozzle 14 through the nozzle plate and onto a print medium. The ink drawn by capillary action into each nozzle 14 from the via 12 is heated by a respective nozzle heater (not shown) located directly under the nozzle 14. Each nozzle heater is controlled by a heating pulse driven by plural nozzle drive transistors 16 (FIG. 2). In practice, because the circuits of the printhead substrate 10 are CMOS, the nozzle drive transistors 16 are NMOS FET devices. Indeed, in order to lower the internal resistance of the nozzle drive transistors 16, multiple parallel-connected FET devices 16 are connected together. As such, a majority of the power delivered by the nozzle drive FET devices is dissipated in the nozzle heaters, rather than in the FET drive transistors 16 themselves.

As noted above, the ink is often preheated in the printhead 10 to maintain the ink at a desired temperature so that the viscosity and other properties remain constant, thus assuring a consistent print quality. To that end, the printhead 10 in this example is constructed with a distributed heating system that provides thermal energy to the ink in the ink vias 12 so that the temperature remains constant over the entire area of the nozzle structures. The thermal energy is distributed with different intensities to the nozzle structures of the semiconductor printhead 10, as well as changed when needed during the printing process. This reduces hot spots, such in the middle of the substrate with centrally-located nozzle structures, where less heat is dissipated therefrom, as well as in areas where the jetting nozzles 14 are used more during the print process.

A number of substrate heaters are employed adjacent the nozzle/jet structures to maintain the temperature of the ink uniform and relatively constant in the ink vias 12, as well as in the nozzle structures. FIG. 1 illustrates the ink via 12 with a number of groups of substrate heaters cells, one group shown as numeral 20. The via 12 is shown much wider than in practice for purposes of clarity of understanding. Located adjacent each side of the ink via 12 are respective nozzle structures 14*a* and 14*b*. The ink via 12 forms a thermal barrier in the semiconductor substrate. The structural features of the group 20 of substrate heaters are similar to the two other groups in the embodiment illustrated, namely group 22 and group 24. There are a similar set of groups 26, 28 and 30 of substrate heaters located on the opposite side of the ink via 12. The groups of substrate heaters are associated with respective zones of the substrate of the printhead 10.

In the embodiment of the printhead 10 shown, the twelve groups of substrate heaters are associated with nine temperature zones of the substrate. The substrate heater group 32 is associated with a first zone, substrate heater group 22 is associated with a second zone, and substrate heater group 20 is associated with a third zone. The substrate heaters 38, 40 and 42 are similarly associated with three respective zones. The substrate heater groups 38, 40 and 42 are controlled by respective temperature sensors 50, 52 and 54. The substrate heaters 20-24 and 38-42 are associated with temperature zones located on the opposite sides of the printhead substrate 10. The substrate heater groups 30 and 48 are located in seventh zone, substrate heaters groups 28 and 46 are located in an eighth zone, and substrate heater groups 26 and 44 are located in a ninth zone. It can be seen that in the center of the printhead substrate 10, there are two substrate heater groups for each temperature zone. As will be described in detail below, each group of substrate heaters can be independently controlled to supply the thermal energy required by its associated zone and maintain the substrate nozzle structure temperatures relatively constant and uniform. However, since the centrally-located heater groups 30 and 48, for example, are monitored by a single temperature sensor 56, both substrate heater groups 30 and 48 are driven in unison by the same drive signal.

The temperature control system includes a number of temperature sensors, one shown as numeral 32. Again, there is a temperature sensor 32 associated with each temperature zone. For example, temperature sensor 32 is located to monitor the temperature of the substrate in the zone associated with substrate heater group 24, temperature sensor 34 monitors the temperature in the zone associated with substrate heater group 22, temperature sensor 36 monitors the temperature in the zone associated with the substrate heater group 20, and so on with the other temperature sensors 50, 52 and 54 and respective substrate heater groups 38, 40 and 42. The three central substrate heater groups (30, 48), (28, 46) and (26, 44) are controlled by respective temperature sensors 56, 58 and 60. Accordingly, in the center of the printhead substrate 10, one temperature sensor, for example, monitors the temperature produced, in part, by two respective substrate heaters. It should be noted that in practice, the temperature sensors are located a distance from the respective substrate heater, substantially the same as the nozzle structures are located from the substrate heater. As such, the substrate temperature sensed by the sensors is approximately the same as that of the corresponding nozzle structures.

In practice, the temperature sensors 32 are fabricated in the semiconductor material of the printhead substrate 10. A delta $V_{be}$ bipolar diode of conventional design is formed in the semiconductor material of the substrate to monitor the temperature thereof. The delta $V_{be}$ diode is well known for its linear voltage/temperature relationship. In addition, such type of sensor requires very little semiconductor area. However, the utilization of the delta $V_{be}$ diode is not critical to the operation of the substrate heater of the invention. Other types of temperature sensors can be employed to monitor the temperature of the printhead substrate 10. The particular type of temperature sensor is not part of the invention.

FIG. 2 is an enlarged view of a portion of the substrate heater system according to an embodiment of the invention. The ink via 12 is a narrow channel that is formed entirely through the semiconductor material and connects with the ink reservoir coupled to the other side of the printhead substrate 10. The ink reservoir can be a cartridge of other ink delivery mechanism. The nozzles structures 14 are located close to the ink via 12 so that the ink is drawn by capillary action into the nozzle cavity. Located adjacent to each nozzle structure 14 is a nozzle driver transistor 16. In an embodiment of the invention, the nozzle driver 16 comprises plural FET devices connected in parallel to drive the corresponding nozzle heater to rapidly heat the ink in the nozzle cavity. Many more FET nozzle driver transistors 16 can be employed than the number shown. Each FET nozzle driver transistor 16 includes a gate connected in common to a gate conductor, a drain connected in common to the nozzle heater, and a source connected in common to a ground potential. In this example, the geometry of the nozzle driver transistors 16 is circular in shape to reduce the capacitance thereof and to maximize the gate width. The plural FET nozzle driver transistors 16 are adapted to couple a high speed power pulse to the nozzle heater to fire the nozzle 14 and produce a jetted droplet of ink.

Located adjacent the nozzle driver transistors 16 are substrate heater transistors 60*a* and 60*b*. The substrate heater transistors 60*a* and 60*b* are constructed in the same manner as the nozzle driver transistors 16, and in the same general location. In other words, where there are a cluster of nozzle driver transistors 16, there are co-located therewith the substrate heater transistors 60*a* and 60*b*. Indeed, since the semiconductor area is to be used efficiently, the resistance of the nozzle heaters can be increased so that the requisite thermal energy is produced, and fewer nozzle drive transistors 16 are needed. Thus, what was previously designed to be a nozzle driver transistor 16, can now be used as a substrate heater transistor 60, where the substrate heater transistors 60*a* and 60*b* source terminals are connected to the same source terminals as the nozzle driver transistors 16. Thus, the semiconductor area is conserved without requiring an entirely new area for the substrate heater transistors 60*a* and 60*b* and conductor connections thereto. It should be noted that in one embodiment, the pair of substrate heater transistors for each substrate heating cell is co-located with the group of nozzle driver transistors, and could otherwise be used to drive the nozzle heaters. In another embodiment, there is a pair of nozzle structures located thermally adjacent to a distributed substrate heating resistor and a pair of switching transistors. Other combinations of nozzle structures and substrate heating components can be thermally located together. It should be noted that the term "thermally adjacent" means that the components are sufficiently close to one another that the thermal energy generated by the heating element can raise the temperature of the ink in the nozzle structure to a desired temperature. In FIG. 2, the pair of substrate heater transistors 60*a* and 60*b* are located adjacent the nozzle driver transistors 16, which, in turn, are located adjacent a corresponding nozzle structure 14. All other portions of the substrate heaters are similarly constructed and distributed next to respective nozzle structures.

The substrate heater transistors 60*a* and 60*b* are connected in parallel as a pair, and the pair 60 is connected in parallel with other pairs of substrate heater transistors, such as substrate heater transistor pair 62 associated with the nozzle 66, and substrate heater transistor pair 64 associated with nozzle 68. Accordingly, the pairs of substrate heater transistors are distributed on the substrate with the corresponding nozzle firing and heating structures. Other parallel connected substrate heater transistors are involved in the controlled heating of associated nozzle structures. The pairs of substrate heating transistors 60, 62 and 64 have gate conductors, one shown as numeral 61, all connected to a common gate drive conductor 63. The drain connections of each of the pairs of substrate heating transistors 60, 62 and 64 are connected to a common bus 65 which is connected to an end of a series of distributed substrate heating resistors.

The heating element of the substrate heater comprises a plurality of distributed polysilicon resistors. The polysilicon heating resistor 70 is located adjacent the pair of substrate heating transistors 60. The polysilicon heating resistor 72 is located adjacent the corresponding pair of substrate heating transistors 62. Similarly, the polysilicon resistor 74 is located adjacent the pair of substrate heating transistors 64. Thus, the polysilicon heating resistors of the printhead substrate 10 are distributed along the heating zone with the nozzle structure components. In practice, the metal gate bus 63 overlies the polysilicon heating resistors 70, 72 and 74, which would otherwise not be possible if the substrate heating resistors were constructed of a metal-based material. The metal gate conductor 63 is electrically insulated from the underlying polysilicon resistors 70-74 by a layer of silicon oxide. The individual polysilicon resistors 70-74 are connected together with metal interconnections, one interconnection shown as numeral 76, so that series of individual heating resistors is provided. The advantage of this structure is that the substrate heating element itself is concentrated at the site of the nozzle structure, and thus concentrates the heat at the nozzle structures. In contrast, many prior art substrate heaters are constructed entirely of a continuous heating element which also heats semiconductors areas between the nozzle structures.

Figure 2B:
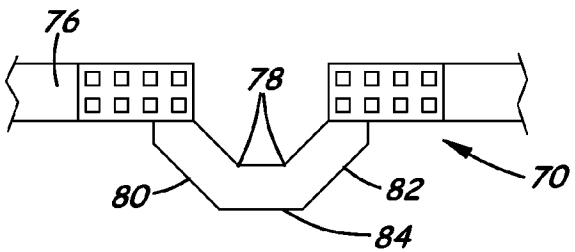
FIG. 2*b* is a top view of the features of a polysilicon substrate heating resistor of the invention.

The polysilicon substrate heating resistors 70-74 are constructed so as to provide a concentrated resistance, sufficient to handle the requisite current, in a small semiconductor area. The details of the polysilicon resistor 70 are shown in FIG. 2*b*. The other polysilicon resistors are constructed in the same manner. The polysilicon is deposited and processed so as to minimize inside corners which otherwise would cause a current concentration at such location and a corresponding hot spot. To circumvent the disadvantage of using a square inside corner, the polysilicon resistor 70 has two inside angles 78. Thus, the shape of the polysilicon resistor 70 is "bridge" or "arch" shape with a pair of inwardly angled sides 80 and 82, and a cross member 84. In the preferred embodiment, the sides 80 and 82 are angled 45°. The bottom of the angled sides 80 and 82 of the polysilicon resistor 70 are electrically connected to the respective metal strips 76 and thus to respective neighbor polysilicon resistors. The thickness and width of the polysilicon is constructed to provide a cross-sectional area sufficient to handle the current necessary to heat the polysilicon material. The doping of the polysilicon can be controlled to provide the desired resistance to each resistor. A series of polysilicon resistors, together with a multiple-FET transistor switch to control the switching of heating current through the resistor string is identified as a substrate heating cell.

Figure 3:
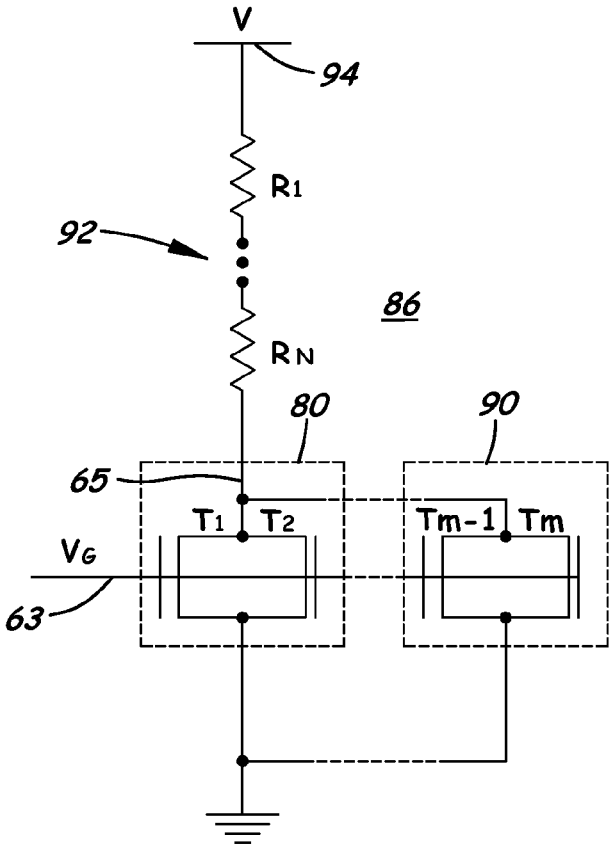
FIG. 3 is an electrical schematic diagram of one substrate heater cell of the invention.

FIG. 3 illustrates a substrate heating cell 86. The heating cell 86 can include a different number of resistors and a different number of FET transistors. Accordingly, a heating cell 86 can include n polysilicon resistors $R_1$-$R_n$ connected in series, and m parallel-connected FET transistors $T_1$-Tm. As noted above, The FET transistors are arranged in pairs, and the pairs of FET transistors are distributed with the nozzle structures in the same manner as the polysilicon heating resistors. The parallel connection means that the drains of the transistors are connected together and to the string of polysilicon resistors, and the sources of the FET transistors are all connected together to the same ground system as the nozzle heating FET transistors 16. The FET transistors $T_1$ and $T_2$ comprise a pair 88 that are connected in parallel. The FET transistors $Tm_{-1}$ and Tm comprise a pair that is also connected in parallel. The other FET transistors T are similarly arranged. All pairs of FET transistors of a cell are thus connected in parallel. Those skilled in the art may prefer to distribute a single substrate heating transistor (or a different number) at one or more nozzle structures, rather than a pair.

The drain connections of each of the FET transistors $T_1$-Tm are connected in common to the drain bus 65, which connects to the bottom of the resistor string 92. The FET transistors are each constructed as NMOS devices. The top of the polysilicon resistor string 92 is connected to a supply voltage rail 94 (V). A common gate drive Vg is coupled to the gate of each of the FET transistors $T_1$-Tm by way of the gate bus 63. Each time the gate drive is active, all FET transistor $T_1$-Tm are simultaneously driven into conduction to drive a heating current through all polysilicon substrate heating resistors $R_1$-Rn. The gate drive signal Vg is a pulse having a width of a desired duration to produce the thermal energy needed.

Figure 4:
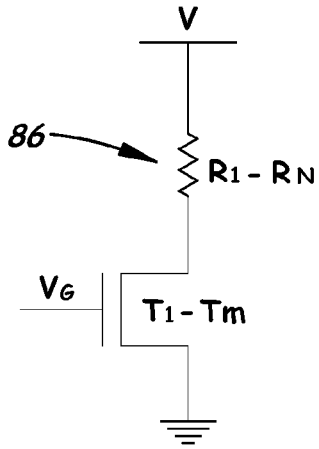
FIG. 4 is an electrical schematic diagram of a simplified substrate heater cell illustrated in FIG. 3.
Figure 5:
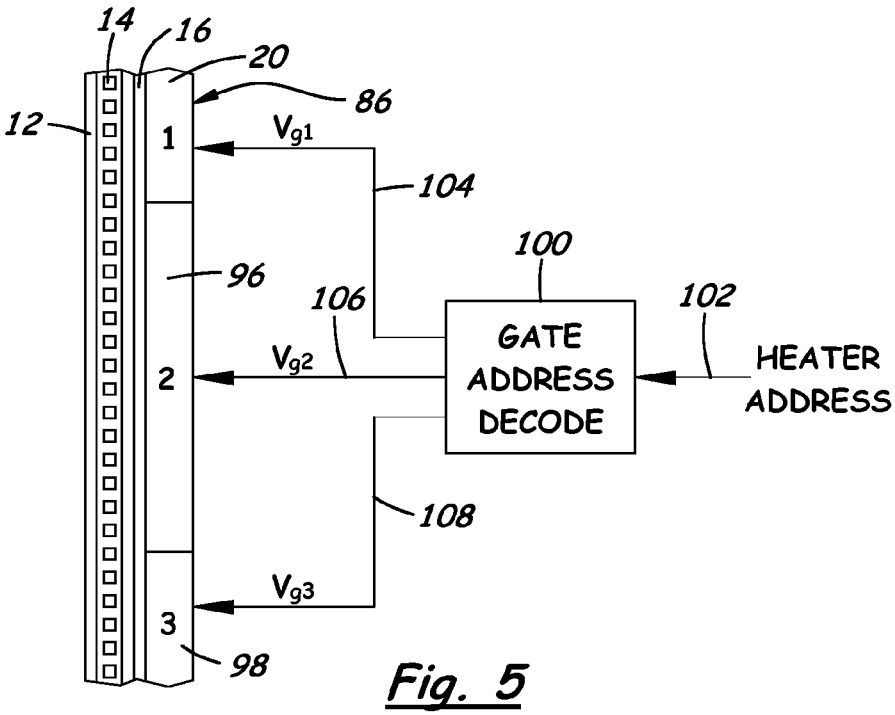
FIG. 5 is a simplified diagram of a number of substrate heater cells and the control therefor.

The equivalent substrate heating cell 86 of FIG. 3 is illustrated in FIG. 4. The n series substrate heating resistors provide a composite effective resistance. With the m switching transistors connected in parallel, an overall low channel resistance is achieved. FIG. 5 depicts a printhead substrate equipped with three substrate heating cells 86, 96 and 98, each similarly constructed in the manner noted above. A gate address and decode circuit 100 receives an address from the printhead controller and decodes the same to determine which substrate heating cell 86, 96 or 98 to activate. More than one substrate heating cell can be active at a time. The addresses are coupled from the controller to the gate address decode circuit 100 on address bus 102. The output of the gate address decode circuit 100 includes a gate drive line 104 providing a $Vg_1$ gate signal to the substrate heating cell 86. In like manner, a gate signal $Vg_2$ is provided to substrate heating cell 96 on conductor 106, and a gate signal $Vg_3$ is provided to the substrate heating cell 98 on conductor 108. Again, it is noted that the substrate heating cells 86, 96 and 98 are arranged linearly along the nozzle driver transistors 16, which are located adjacent the jetting nozzles 14. As described above, the ability to place the substrate heating cells thermally adjacent to the ink vias, and the ink cavities in the jetting nozzles, allows the ink temperature to be carefully controlled and maintained uniform.

Figure 6:
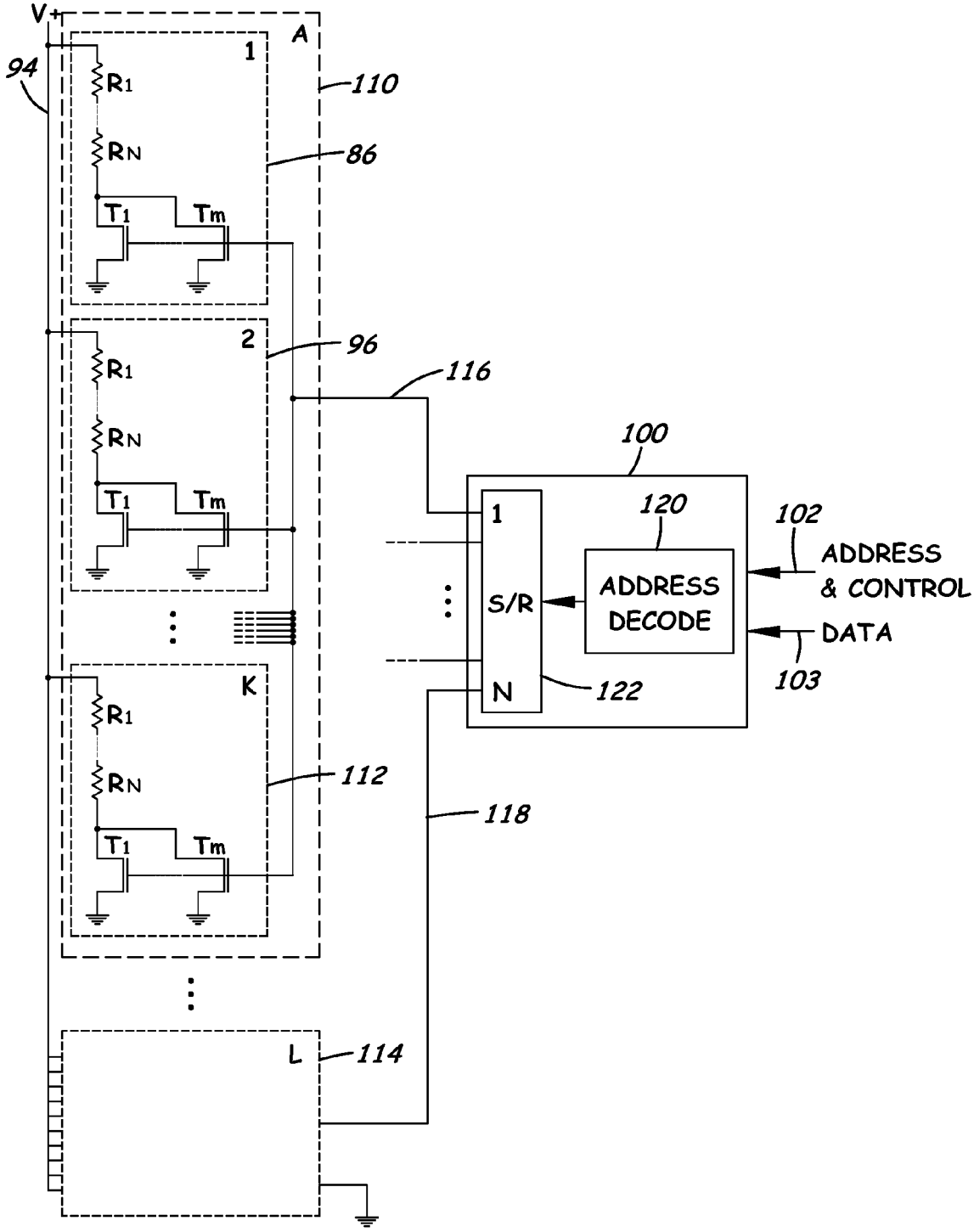
FIG. 6 is a schematic diagram of a configuration of a number of substrate heating cells for heating a printhead substrate.

With reference now to FIG. 6, there is illustrated the details of another embodiment of the substrate heating system of the invention. Here, there is illustrated a substrate heater section 110 that includes ten heating cells, three of which are identified as numerals 86, 96 and 112. It should be noted that the resistor string in each heating cell 86, 96 and 112 is physically arranged in an elongate string parallel to and in close proximity to the nozzle heating/jetting structures. Not only are the m FET transistors in each heater cell driven in parallel, but all the FET transistors in the substrate heater section 110 are driven as well by the same drive signal. In other words, since there are m FET transistors per substrate heating cell 86, and there are an illustrated k heating cells in a heating section 110, there are a substantial number of FET substrate heating transistors driven simultaneously. However, while all of the FET heating transistors of the substrate heating section 110 are distributed physically in pairs, each transistor pair is electrically connected to the others in parallel, and distributed in association with a corresponding polysilicon heating resistor.

The substrate heating system shown in FIG. 6 can include multiple sections, from section A noted by numeral 110, to section L denoted by numeral 114. The substrate heater section 114 can be constructed like that shown as section 110. Indeed, for as many substrate heating sections that are required to maintain a desired ink temperature at the corresponding nozzle structures, such sections can be arranged as shown and driven by a common gate drive circuit 100. The gate address control can receive a gate address on bus 102, and data on a data bus 103. An address decode circuit 120 decodes the address and loads a shift register 122 with data bits received. The shift register 122 loads bits therein corresponding to whether a certain gate drive signal Vg should be active, or not. The gate drive signals Vg1-Vgn are coupled via lines 116-118 to the respective heater sections A-L. For example, the bit positions of the shift register 122 can be loaded with logic ones if the heater sections should be active, and with logic zeroes if the substrate heater sections should remain inactive, or loaded with a combination of ones and zeroes. When the shift register 122 is clocked, the latched logic signals will be output therefrom and will drive each substrate heating section accordingly. The heating sections will remain in such state until a new gate signal is received from the shift register 122. If a substrate heating section is generating heat for a zone of the semiconductor substrate, and the respective temperature sensor indicates that the zone temperature will exceed a predefined temperature, then the controller can load the shift register 122 with new data to turn off the substrate heater section of interest. Thus, the duration between shift register operations determines the time in which a substrate heater will be active or inactive.

From the foregoing, disclosed is a substrate heating system for an inkjet printhead. The substrate heater employs a series of heating resistors physically distributed with the jetting nozzle structures. For each substrate heating resistor, there is located thermally adjacent thereto at least one nozzle structure. In addition, the FET switches that control the substrate heating resistors are also physically distributed with the heating resistors. While a pair of FET switches are utilized adjacent each other, and pairs of FET transistors are distributed at different locations, a single FET transistor or a different number of FET switches could be located at one or more nozzle structure sites. In addition, the FET transistors associated with the heating resistor string are co-located with the nozzle drive transistors, thus achieving an efficiency in the use of semiconductor area. The substrate heating resistors are constructed with polysilicon and can be used in close proximity with other metal conductors or buses, without the heat generated by the polysilicon resistor affecting adjacent circuits or materials. The substrate heating cells can be arranged in many configurations and located at critical substrate locations to provide thermal energy when desired. A control circuit can control the state of the substrate heating cells so that a desired temperature can be maintained.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A substrate heater for an inkjet printhead having a plurality of ink jet nozzle structures, comprising:

a plurality of series-connected substrate heating resistors;

a plurality of parallel-connected switching transistors for controlling current through said heating resistors, said plurality of series-connected substrate heating resistors being connected together in series with the plurality of parallel-connected switching transistors; and wherein one of said heating resistors and one of said switching transistors is located thermally adjacent a nozzle structure of a plurality of nozzles.

2. The substrate heater of claim 1 wherein said switching transistors comprise FET devices.

3. The substrate heater of claim 1 wherein said substrate heating resistors and said switching transistors comprise a first cell connected between a power and ground, and further including a second cell of said heating resistors and said switching transistors connected between said power and ground, and further including a common drive signal for driving each said cell.

4. The substrate heater of claim 3 wherein each substrate heating resistor of the first cell is connected together in series, and the switching transistors of the first cell are connected together in parallel, and wherein the substrate heating resistors and the switching transistors of said second cell are connected in the same manner as the said first cell.

5. The substrate heater of claim 1 wherein said nozzles each include at least one transistor for causing ink to be jetted therefrom, and wherein said switching transistors are each located adjacent a respective jetting transistor.

6. The substrate heater of claim 5 wherein said switching transistors and said nozzle transistors comprise FET devices, and wherein a source connection of said FET transistors are connected together.

7. The substrate heater of claim 1 wherein said substrate heating resistors are constructed of polysilicon and are of a resistance value to produce thermal energy and heat ink held in said inkjet printhead.

8. The substrate heater of claim 7 wherein said polysilicon resistors are arch shaped.

9. The substrate heater of claim 7 wherein each said polysilicon resistor is overlaid by a metal conductor.

10. The substrate heater of claim 1 wherein plural said switching transistors are located adjacent each said substrate heating resistor.

11. The substrate heater of claim 1 wherein each said substrate heating resistor is constructed of polysilicon, and said polysilicon heating resistors are connected together in series with respective metal interconnections.

12. A substrate heater for an inkjet printhead having a plurality of ink jet nozzle structures, comprising:

a plurality of series-connected substrate heating resistors forming a string, one end of said string connected to a supply voltage;

each said resistor connected to a neighbor resistor by a low resistance conductor;

at least one switching transistor connected to a different end of the resistor string; and each resistor of said resistor string located thermally adjacent at least one respective nozzle structure, whereby the number of nozzle structures equal or exceed the number of substrate heating resistors.

13. The substrate heater of claim 12 wherein each said substrate heating resistor is constructed with polysilicon.

14. The substrate heater of claim 12 wherein said switching transistor is a FET transistor, and further including a plurality of FET switching transistors connected in parallel.

15. The substrate heater of claim 12 wherein at least two said switching transistors are located adjacent a respective said substrate heating resistor.

16. A substrate heater for an inkjet printhead having a plurality of ink jet nozzle structures, comprising:

a plurality of series-connected polysilicon substrate heating resistors, each said polysilicon heating resistor connected to a neighbor polysilicon heating resistor with a metal interconnection;

a plurality of parallel-connected FET switching transistors, a respective drain connection of said parallel-connected FET switching transistors connected to said series-connected polysilicon substrate resistors for controlling heating current therethrough;

a gate of each said parallel-connected FET switching transistor connected in common and driven by a common drive signal; and one said polysilicon resistor and a pair of said FET switching transistors forming a group, and wherein at least one said nozzle structure is located thermally adjacent a polysilicon heating resistor of one said group.

17. The substrate heater of claim 16 wherein the pair of said FET switching transistors of each group is located adjacent at least one respective nozzle.

* * * * *